United States Patent [19]

Degerbeck

[11] 4,222,773

[45] Sep. 16, 1980

[54] CORROSION RESISTANT AUSTENITIC STAINLESS STEEL CONTAINING 0.1 TO 0.3 PERCENT MANGANESE

[75] Inventor: Jörgen Degerbeck, Fagersta, Sweden

[73] Assignee: Fagersta AB, Fagersta, Sweden

[21] Appl. No.: 43,240

[22] Filed: May 29, 1979

Related U.S. Application Data

[63] Continuation of Ser. No. 903,258, May 5, 1978, abandoned.

[51] Int. Cl.[2] ..... C22C 38/02; C22C 38/42

[52] U.S. Cl. ..... 75/125; 75/128 G; 75/128 F; 75/128 N; 75/128 T; 148/38

[58] Field of Search ..... 75/125, 128 N, 128 T, 75/128 G, 128 F; 148/38

[56] References Cited

U.S. PATENT DOCUMENTS

| | | | |
|---|---|---|---|
| 2,447,896 | 8/1948 | Clarke, Jr. | 253/77 |
| 3,303,023 | 2/1967 | Dulis et al. | 75/128 |
| 3,574,601 | 4/1971 | Myers et al. | 75/125 |
| 3,622,307 | 11/1971 | Clarke, Jr. | 75/128 R |
| 3,751,244 | 8/1977 | Mimino et al. | 75/128 G |
| 4,022,586 | 5/1977 | Espy | 75/125 |
| 4,035,182 | 7/1977 | Kowaka et al. | 75/122 |
| 4,055,448 | 10/1977 | Fuzikura et al. | 75/128 N |

FOREIGN PATENT DOCUMENTS

| | | | |
|---|---|---|---|
| 2417632 | 11/1974 | Fed. Rep. of Germany | 75/124 |

*Primary Examiner*—L. Dewayne Rutledge
*Assistant Examiner*—Roy Upendra
*Attorney, Agent, or Firm*—Larson, Taylor and Hinds

[57] ABSTRACT

An austenitic stainless steel which is completely or practically completely austenitic in a hot worked, solution treated state, with properties characteristic for such steel and with a corrosion resistance clearly superior to the AISI 304 type of 18/8-steel, at least on a par with AISI 316 type of acid resistant steel 17/12-2Mo. The steel consists essentially of less than 0.10% C, less than 1.5% Si, between 0.10 and 0.30% Mn, between 17 and 20% Cr, between 6 and 16% Ni, between 2.0 and 4.0% Cu, less than 0.40% N, less than 1.0% Ti, less than 1.5% Nb and less than 100 ppm B, the balance being iron and impurities such as S, P and Mo usually present in steel.

8 Claims, No Drawings

CORROSION RESISTANT AUSTENITIC STAINLESS STEEL CONTAINING 0.1 TO 0.3 PERCENT MANGANESE

This is a continuation of application Ser. No. 903,258 filed May 5, 1978, now abandoned.

The present invention relates to an austenitic stainless steel, which is completely or practically completely austenitic in a hot worked, solution heat-treated state, with properties characteristic for such steel and with a corrosion resistance clearly superior to the AISI 304 type of 18/8-steel, at least on a par with AISI 316 type of acid resistant steel 17/12-2Mo.

It is well known that the acid-resistant steels, e.g. AISI 316, are superior to the stainless steels, e.g. AISI 304, not only with regard to general corrosion resistance in reducing and weakly oxidizing acids such as hydrochloric acid, sulphuric acid and various organic acids, but also against atmospheric corrosion and the especially dangerous type of local corrosion such as pitting and crevice corrosion caused by chlorides.

More particularly, the invention relates to an austenitic stainless steel of the AISI 304 type which, by alloying with copper in combination with a minor manganese content as well as alloying with boron, gives a corrosion resistance clearly superior to that applying for the AISI 304 steel, and at least on a par with that for AISI 316, while at the same time retaining a completely austenitic structure and the good manufacturing and utilization properties of the austenitic steels.

The object of the invention is to obtain an acid-resistant steel, novel from the point of view of alloying techniques, with corrosion properties which are as good as, or better than those applying for the AISI 316 type of steel.

In order to attain the object of the invention regarding resistance to corrosion, it is necessary to lower the manganese content as well as to alloy copper. Boron is added primarily to compensate for the somewhat negative effect a lowered manganese content and the alloying of copper has on hot ductility, and therefore to fulfil the object of the invention that manufacturing properties shall also be satisfactory.

With regard to chemical composition, the invention can be exemplified by the following typical analysis: 18% Cr, 9% Ni, 3% Cu, 0.15% Mn, 15 ppm B.

The novel and characterizing composition of a steel according to the invention is apparent from the patent claims.

The effects of the individual alloying substances Mn, Cu and B in austenitic stainless steel of the AISI 304 type, with respect to corrosion resistance are as follows:

Manganese: Lowering the Mn-content from the normal ratio of 1 to 2% down to 0.1 to 0.2% results in an increase in the initiating resistance to pitting and crevice corrosion to at least that applicable for the AISI 316 type of steel. The reason for this positive effect is that the manganese sulphide normal in austenitic stainless steel is transformed into a chemical resistant chromium sulphide when the manganese content of the steel is lowered. The normal manganese sulphide has poor chemical durability and serves as initiation location for pitting and crevice corrosion. The amount of manganese may not be reduced completely arbitrarily however, since initiation resistance begins to drop at contents below 0.05 to 0.10%. With regard to the resistance against propagation of pitting and crevice corrosion, general corrosion in weakly oxidizing acids and stress corrosion, lowering the manganese content only results in a marginally positive effect.

Copper: 2 to 3% copper does not notably affect initiation resistance to pitting and crevice corrosion, but has a strongly positive effect on the resistance to propagation, and alloying copper similarly drastically improves the general corrosion resistance of the austenitic stainless steels in hydrochloric acid, sulphuric acid and remaining reducing and weakly oxidizing acids, and as a consequence, resistance to atmospheric corrosion and corrosion fatigue increases.

Boron: In amounts laid down by the invention, boron has a positive effect on the resistance to intercrystalline corrosion caused by heat treatment in the temperature range 600°–800° C. For the remainder, boron has no notable effect on corrosion resistance.

With regard to the effect of manganese, copper and boron on remaining properties, the following may be stated:

Lowered manganese content causes a certain depreciation of hot ductility and somewhat less austenitic stability.

Alloying copper increases austenitic stability and decreases cold hardening.

Alloying boron improves hot ductility.

The invention will now be more closely described in conjunction with a series of steels having compositions falling in the vicinity of, or within the purview of the invention.

Corrosion resistance, strength and hot ductility have been investigated for steels according to the invention, their chemical composition being accounted for in table A, such as the steels 1–3 and 5–6. The compositions of the AISI steels 304 and 316 are given for comparison.

The initiation resistance to pitting (and crevice corrosion) is denoted by the "pitting potential" in table B. The higher the potential, the better its initiation resistance.

A total effect of the corrosion initiation and propagation resistance is accounted for in table C in the form of loss in weight obtained in 10% $FeCl_3$.

Resistance to strongly oxidizing acids is exemplified by the general corrosion speed in 65% boiling nitric acid (the Huey-test). See table D.

In table E are shown the results from potentiodynamic anodic polarisation in sulphuric acid in the form of corrosion potential, passifying potential and critical passifying current density, $I_{crit}$. The most important parameter $I_{crit}$ indicates how easily a steel is passified. The lower $I_{crit}$ is, the better the condition.

Corrosion resistance in sulphuric acid is accounted for in table F.

Corrosion resistance in hydrochloric acid is accounted for in table G.

Tensional strength is accounted for in table H.

Hot ductility, i.e. the effect of boron, is shown in table J.

It will be seen from tables B to J that steel according to the invention has corrosion resistance in environments and for types of corrosion typical for steel of the AISI 316 type, which are as good as or better than those applying for this steel, that the strength is normal for austenitic stainless steel and that boron clearly improves the hot ductility of the steel.

TABLE A

| Steel | Nb | Ti | C | Si | Mn | P | S | Cr | Ni | Mo | N | Cu | B ppm |
|---|---|---|---|---|---|---|---|---|---|---|---|---|---|
| | | | | | Chemical composition | | | | | | | | |
| 1 | — | 0.48 | .050 | .55 | .11 | .021 | .011 | 19.7 | 9.0 | .20 | .032 | 3.16 | 15 |
| 2 | 0.70 | — | .055 | .55 | .12 | .021 | .019 | 19.1 | 7.5 | .50 | .031 | 3.65 | 5 |
| 3 | — | — | .048 | .55 | .13 | .015 | .011 | 18.7 | 9.1 | .11 | .031 | 2.12 | 20 |
| 5 | — | 0.45 | .045 | .46 | .30 | .011 | .014 | 18.4 | 9.1 | .24 | .023 | 2.65 | — |
| 6 | 0.45 | — | .032 | .49 | .26 | .011 | .012 | 18.5 | 8.9 | .22 | .029 | 2.63 | 13 |
| 7 AISI 304 | | | .034 | .47 | 1.08 | .024 | .011 | 18.3 | 8.6 | .17 | .020 | — | — |
| 8 AISI 316 | | | .029 | .38 | 1.48 | .029 | .005 | 16.7 | 11.7 | 2.53 | .021 | — | — |

TABLE B

| Pitting potential, Ep, in 0.1 M NaCl at 25° C. | |
|---|---|
| Steel | Ep in mV $E_{sce}$ (average) |
| 1–3 | 450 |
| AISI 304 | 300 |
| AISI 316 | 420 |

TABLE C

| Pitting in 10% $FeCl_3$ at room temperature, for a period of 24 hours | |
|---|---|
| Steel | Corrosion, $g/m^2 \cdot h$ |
| 3 | 3.1 |
| 7 AISI 304 | 9.8 |
| 8 AISO 316 | 3.8 |

TABLE D

| Huey test. Corrosion in boiling 65% $HNO_3$ for 5 periods at 48 h/period | | | | | |
|---|---|---|---|---|---|
| | Corrosion, $g/m^2 \cdot h$ period | | | | |
| Steel | 1 | 2 | 3 | 4 | 5 |
| 2 | 0.25 | 0.17 | 0.17 | 0.18 | 0.19 |
| 3 | 0.22 | 0.15 | 0.15 | 0.17 | 0.15 |

TABLE E

| Potentio-dynamic anodic polarization in 1 M $H_2SO_4$ at 25° C. | | | |
|---|---|---|---|
| | mV $E_{sce}$ | | $\mu A/cm^2$ |
| Steel | Corrosion potential | Passification potential | Critical passification current density |
| 1–3 | −320 á | −230 á | 50 á 30 |
| | −330 | −260 | |
| AISI 304 | −380 á | −310 á | 310 á 560 |
| | −410 | −330 | |
| AISI 316 | −320 á | −260 á | ~100 |
| | −380 | −310 | |

TABLE F

Corrosion in sulphuric acid, weight loss

The experiments were carried out at room temperature for 1+3+3 periods of 24 hours, the solution being changed after each period. Before each of the three test periods, the samples were activated by means of a Zn rod.

| | | | Corrosion, $grams/m^2 \cdot h$ (mm/year) | | | |
|---|---|---|---|---|---|---|
| Steel | % Cu | $H_2SO_4$ | 24 hours | 3 × 24 h | 3 × 24 h | Average |
| 3 | 2.12 | | 0 | 0.08 | 0 | |
| 1 | 3.16 | 10 | 0 | 0.01 | 0 | |
| 2 | 3.65 | | 0.01 | 0.01 | 0 | |
| " | " | | 0.11 | 0.22 | 0.19 | 0.19 |
| " | " | 15 | 0.06 | 0.19 | 0.15 | 0.15 |
| " | " | | 0.08 | 0.04 | 0 | 0.03 |
| " | " | | 0.31 | 0.22 | 0.21 | 0.23 |

-continued

| | | | Corrosion, $grams/m^2 \cdot h$ (mm/year) | | | |
|---|---|---|---|---|---|---|
| Steel | % Cu | $H_2SO_4$ | 24 hours | 3 × 24 h | 3 × 24 h | Average |
| " | " | 20 | 0.25 | 0.23 | 0.19 | 0.21 |
| " | " | | 0.21 | 0.20 | 0.08 | 0.15 |
| " | " | | 0.46 | 0.22 | 0.11 | 0.21 |
| " | " | 25 | 0.24 | 0.15 | 0.08 | 0.13 |
| " | " | | 0.20 | 0.15 | 0.11 | 0.14 |
| " | " | | 0.62 | 0.19 | 0.18 | 0.25 |
| " | " | 30 | 0.26 | 0.14 | 0.10 | 0.14 |
| " | " | | 0.22 | 0.15 | 0.11 | 0.14 |

As is apparent from the tables, all three steels according to the invention are in a stably passive condition at room temperature in 10% $H_2SO_4$ and steel No. 2 (with 3.65% Cu) in 15% $H_2SO_4$ as well. For a further increased $H_2SO_4$ concentration (15→30%), the corrosion rate only increases very marginally. Excepting period 1 (which is as it should be), the corrosion rate is 0.14 $g/m^2 \cdot h$ (approved result) for the steels with the highest Cu-content, and 0.19 $g/m^2 \cdot h$ for the steel having the lowest Cu-content.

The steel type AISI 304 is only good for 3% $H_2SO_4$, while the steel type AISI 316 is good for about 20% $H_2SO_4$.

TABLE G

| Corrosion in HCl. Room temperature. Time 24 hours | | |
|---|---|---|
| Steel | HCl % | Corrosion $g/m^2 \cdot h$ (mm/year) |
| 3 | 1 | 0.05 |
| 1 | 1 | 0.00 |
| 2 | 1 | 0.01 |
| 7 AISI 304 | 1 | 0.58 |
| 8 AISI 316 | 1 | 0.00 |
| " | 2 | 0.12 |
| " | 2 | 0.12 |
| " | 2 | 0.14 |
| " | 2 | 1.42 |
| " | 2 | 0.38 |
| " | 3 | 0.15 |
| " | 3 | 0.16 |
| " | 3 | 0.18 |
| " | 3 | 1.63 |
| " | 3 | 0.57 |
| " | 5 | 0.15 |
| " | 5 | 0.14 |
| " | 5 | 0.18 |
| " | 5 | 0.82 |
| " | 5 | 0.78 |
| " | 10 | 0.21 |
| " | 10 | 0.18 |
| " | 10 | 0.44 |
| " | 10 | 1.43 |
| " | 10 | 1.58 |

According to this table and available corrosion tables, the AISI 304 and 316 types of steel are only good for 0.1% and 1.0% HCl, respectively, at room temperature and for stationary solution. Furthermore, the AISI 304 and 316 steels are attacked at a considerably greater rate e.g. for 10% HCl than the steel according to the invention, when all three steels are in an active state.

TABLE H

| Steel | % Cu | Tensional strength Rp 0.2 N/mm² | Rm N/mm² | A5 % |
|---|---|---|---|---|
| 1 | 3.16 | 254 | 560 | 52 |
| 2 | 3.65 | 256 | 557 | 52 |
| 3 | 2.12 | 247 | 547 | 59 |

TABLE J

Hot ductility according to hot tensile strength test with the strain rate of $10 \cdot s^{-1}$ for temperature 950°–1250° C.

The samples are taken perpendicular to the fusion direction from the ingot halves.

| | Steel | Area contraction in % Average value 950, 1000 and 1950° C. |
|---|---|---|
| 5 | According to the invention | 22 |
| 6 | According to the invention | 38 |
| 4 | Steel type AISI 306 with 2.7% Cu | 40 |

What I claim is:

1. Austenitic stainless steel, completely or practically completely austenitic in a hot-worked, solution heat-treated condition, characterized in that it consists essentially of:

C<0.10%
Si<1.5%
Mn 0.10–0.30%
Cr 17–20%
Ni 6–16%
Cu 2.0–4.0%
N>0.40%
Ti>1.0%
Nb>1.5%
B>100 ppm
the remainder consisting of iron and impurities normally present in steel, e.g. S, P and Mo.

2. Steel as claimed in claim 1, characterized in that the contents of C, Si, Ni and Cu are the following:

C<0.050%
Si<1.0%
Ni 7–11%
Cu 2.0–3.7%.

3. Steel as claimed in claim 1 or 2, characterized in that the boron content is 5–25 ppm.

4. Steel as claimed in claim 1, characterized in that the content of C is less than 0.035% and the content of N is 0.020–0.22%.

5. Steel as claimed in claim 4, characterized in that the content of C is less than 0.03%.

6. Steel as claimed in claim 1, characterized in that the content of C is less than or equal to 0.08%, the relationship $Ti \geqq 8 \times C$, applying for the proportions of C and Ti.

7. Steel as claimed in claim 1, characterized in that the content of C is less than or equal to 0.08%, the relationship $Nb \geqq 12 \times C$ applying for the proportions of C and Nb.

8. Steel as claimed in claim 1, characterized in that the proportions of C, Si, Cr, Ni, Cu, N and Ti are as follows:

C 0.030–0.055%
Si<0.80%
Mn 0.10–0.30%
Cr 18–20%
Ni 7.5–10%
Cu 2.6–3.7%
N 0.020–0.25%
Ti<0.5%.

* * * * *